United States Patent [19]

Ueno

[11] 4,049,938

[45] Sept. 20, 1977

[54] MICROWAVE OVEN

[75] Inventor: Akihiko Ueno, Higashiosaka, Japan

[73] Assignee: Matsushita Electric Industrial Co., Ltd., Osaka, Japan

[21] Appl. No.: 685,135

[22] Filed: May 11, 1976

[30] Foreign Application Priority Data

May 17, 1975 Japan .....50-58853
Nov. 18, 1975 Japan .....50-139042

[51] Int. Cl.[2] ..... H05B 9/06

[52] U.S. Cl. ..... 219/10.55 R; 219/10.55 B; 219/10.55 F; 73/355 EM

[58] Field of Search ..... 219/10.55 R, 10.55 A, 219/10.55 B, 10.55 C, 10.55 D, 10.55 E, 10.55 F, 10.55 M, 10.77; 73/355 R, 355 EM; 250/341, 347, 351

[56] References Cited

U.S. PATENT DOCUMENTS

| | | | |
|---|---|---|---|
| 3,035,143 | 5/1962 | Leatherman | 219/10.77 |
| 3,526,135 | 9/1970 | Wortz | 73/355 R |
| 3,539,807 | 11/1970 | Bickel | 73/355 EM |
| 3,710,062 | 1/1973 | Peters, Jr. | 77/355 R X |
| 3,875,361 | 4/1975 | Fukui et al. | 219/10.55 B |
| 3,884,075 | 5/1975 | Brandi et al. | 73/355 EM |
| 3,985,991 | 10/1976 | Levinson | 219/10.55 E |

*Primary Examiner*—Arthur T. Grimley
*Attorney, Agent, or Firm*—Stevens, Davis, Miller & Mosher

[57] ABSTRACT

A microwave oven includes radiation detecting means for detecting radiations from at least two detection points within a heating oven of the microwave oven. A signal of the radiation detecting means derived from that point of said at least two detection points which is at relatively high temperature is used to control a high frequency wave generator which feeds a high frequency wave into the heating cavity. The radiation detecting means includes a radiation detector and a chopper which chops radiations directed to the radiation detector from said at least two detecting points.

11 Claims, 13 Drawing Figures

MICROWAVE OVEN

The present invention relates to microwave ovens and more particularly to a radiation detecting device for detecting temperatures of food to be cooked.

It has been known and put into practice to contact a temperature sensing device to food or to insert the device into food in order to sense the temperature of the food within a heating cavity of a microwave oven to control the same. However, there are many foods to which the above method is not applicable. For example, when frozen food is to be defrozen, when the temperature of sliced bacon or meat is to be sensed, when the temperature of a food such as cake whose external appearance should not be damaged is to be sensed, or when the temperature of a food having a small thermal capacity is to be sensed, the temperature sensing device cannot be inserted or cannot respond. Thus, the applicable range of the above-mentioned temperature sensing device has been restricted. The prior art microwave oven includes a timer, and a menu card thereof is prepared primarily based on the timer. Therefore, the advantage of the addition of the temperature sensing device is small.

Other temperature sensing devices have been proposed. Japanese Patent Publication No. 24447/73 published July 21, 1973 discloses an electric oven provided with an infrared radiation sensor for detecting the saturation value of infrared energy radiated from food to be cooked. In this device, food items are heated until the infrared radiation therefrom reaches its saturation value. Thus, although the food items are sufficiently heated irrespective of the heat capacity thereof, the saturation value does not always correspond to an optimum cooking temperature and furthermore it is impossible to heat food items to a desired temperature selectively. Furthermore, since such an infrared radiation sensor detects the amount of infrared radiated from the whole inside area of the oven, the detected temperature of the food item is varied depending on the size and shape of the food item and it is also affected by the infrared radiated from the oven itself.

Japanese Utility Model Publication No. 15579/72 discloses a control device for high frequency dielectric heating apparatus. In the latter device, a temperature rise of an article supported between a pair of electrodes is detected by a radiation thermometer. The pair of electrodes are employed to prevent the radiation thermometer from being affected by high frequency electric field. However, these pair of electrodes are not suitable for microwave ovens to support food items to be cooked. In addition, if such a device is to be used for microwave ovens, both the food item and the radiation thermometer must be located at fixed positions and hence the size and shape of the food item are limited.

It is an object of the present invention to detect the temperature of food in a heating cavity of a microwave oven by radiation emitted from the food for controlling the high frequency heating in response to a change in the temperature of the food or the amount of radiation emitted from the food.

It is another object of the present invention to eliminate the influence by radiation emitted from various portions of the heating cavity other than food such as a wall of the heating cavity and to allow correct sensing of the temperature of the food wherever it is placed within the heating cavity, by increasing the number of detection points for the radiation.

It is a further object of the present invention to allow the simplification of the structure of a chopper by constructing the microwave oven such that the article to be heated can be moved.

It is still another object of the present invention to reduce the cost of the microwave oven by the use of a turn table which improves a microwave distribution and to obtain a higher accuracy of detection by increasing the number of detection points.

It is yet another object of the present invention to reduce the size of the microwave oven to minimize a detection error which occurs depending on a position of an article to be heated.

It is another object of the present invention to eliminate noise such as high frequency noise induced in radiation detectors by the use of the property of a metal screen.

It is another object of the present invention to prevent the deposition of water vapor or flakes of a food on the radiation detectors.

According to the present invention a microwave oven comprising a heating cavity in an oven body, a high frequency wave generator for feeding high frequency waves into said heating cavity, radiation detecting means for sequentially detecting radiations from at least two points within said heating cavity, and control means for controlling said high frequency wave generator by a signal from said radiation detecting means, said control means controlling said high frequency wave generator by a signal from one of said two points which is at relatively higher temperature. The radiation detecting means sequentially detects infrared radiation from at least two points in the heating cavity and solid angles which cover the points respectively are made equal. Among the signals produced by detecting these points, a signal derived from the point which radiates substantially the maximum quantity of infrared is used to control the high frequency generator. Thus, the detection of the temperature of the food item is not affected by the variation in the size and shape of the food item as well as the infrared radiation from the heating cavity itself. The control of the high frequency generator of the microwave oven advantageously achieved by the use of the detected food temperature or the use of the detected variation in the infrared radiation from the food item.

The above and other objects, features and advantages of the present invention will become more apparent from the following detailed description of the preferred embodiments of the invention when taken in conjunction with the accompanying drawings.

DESCRIPTION OF THE PREFERRED EMBODIMENTS

Figure 1:
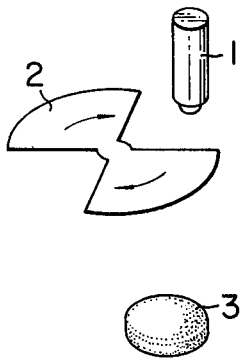
FIG. 1 PRIOR ART
FIG. 1 is a perspective view of a pyroelectric infrared detector in combination with a chopper known in the art.

FIG. 1 shows a principle of operation of a pyroelectric infrared detector 1 which is an infrared detector in combination with a chopper 2. The pyroelectric effect is referred to as a phenomenon in which a change of surface charge occurs when electric dipoles in a crystal having electric self-induced polarization, such as lead titanate $PbTiO_3$, change, the change of the surface charge corresponding to a change in temperature of the crystal, that is, a change in the amount of incident infrared ray. In FIG. 1, reference numeral 1 designate the pyroelectric infrared detector, 2 a chopper and 3 a food. By rotating the chopper 2 so that an infrared ray radiated from the food 3 and directed to the pyroelectric infrared detector 1 is chopped, the temperature change of the food is sensed. Strictly speaking, the chopper 2 should be held at a constant temperature as a reference temperature source. However, by the use of a metal plate having a polished mirror surface and hence having a low emissivity, radiated infrared may be regarded as substantially zero. A signal derived from the pyroelectric infrared detector 1 corresponds to the change in the total amount of incident infrared rays. When this signal is used to detect the temperature of the food in the heating cavity, the detection is influenced in various ways. That is, the total amount of the infrared rays applied to the infrared detector 1 is a function of all of the temperature of the food, surface area thereof, emissivity thereof, the distance from the infrared detector to the food, the incident angle of the infrared ray, and of the infrared rays radiated from the heating cavity per se.

Figure 2:
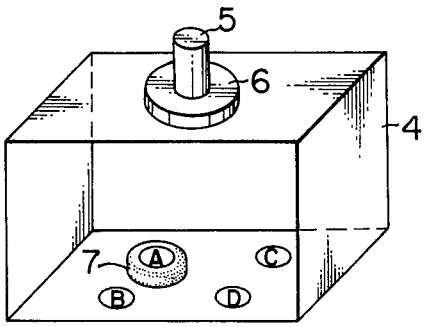
FIG. 2 is a perspective view illustrating a principle of the present invention for eliminating temperature sensing errors caused by radiation emitted from the heating cavity walls.

FIG. 2 shows a principle of the present invention constructed to eliminate those errors, in which 4 designates a heating cavity, 5 an infrared detector, 6 a chopper housing, 7 a food. The infrared detector 5 is constructed such that it can detect infrared rays from areas A, B, C and D in the heating cavity in sequence and solid angles to the respective areas as viewed from the infrared detector 5 are made equal to one another. The infrared detector 5 is also designed such that a substantially maximum value among the infrared outputs from the respective areas is taken out as an input to a control apparatus. When the food 7 is placed in the heating cavity 4 and heated, the amount of infrared rays from the detection area A received by the infrared detector 5 is constant irrespective of the size of the food 7 so long as the food 7 fully covers the detection area A. Furthermore, because the solid angle which represents or corresponds to the detection area of the infrared detector 5 is constant, the accuracy of detection is not influenced by the change in the distance between the infrared detector 5 and the food 7 although the distance varies depending on the shape of the food 7. Since most foods have emissivity of larger than 0.95 and glass or ceramics used as a vessel therefor also has emissivity of larger than 0.9, the error by the change in the emissivity of food is minor. Furthermore, even if the heating oven 4 is heated to the same temperature as the food 7, the area A at which the food is placed and the areas B, C and D at which no food is placed can be readily distinguished by measuring the maximum amount of infrared ray because the inner surface of the heating cavity is made of lustrous metal and the emissivity thereof is around 0.1 at most. The output from the area A thus detected is a function of the average temperature of the food 7 within the area A.

Figure 3:
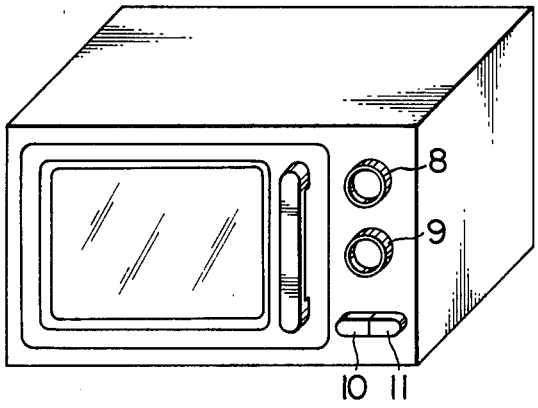
FIG. 3 is an external view of a microwave oven in accordance with one embodiment of the present invention.
Figure 4:
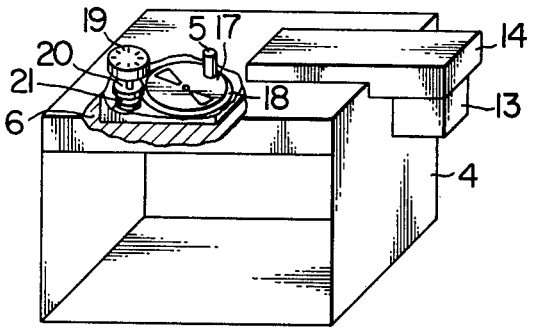
FIG. 4 is a perspective view, partly broken away, of a heating cavity and peripheral portions thereof of the microwave oven of FIG. 3.
Figure 5:
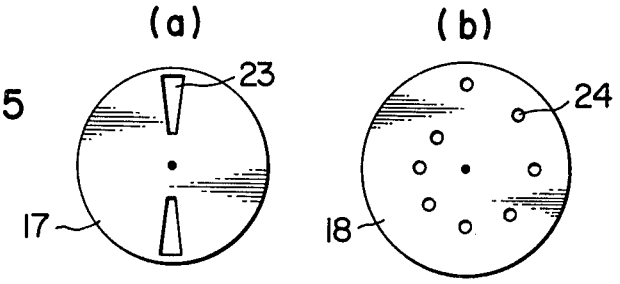
FIG. 5 is a plan view of choppers shown in FIG. 4.

In practice, when the microwave oven is used, the shape and size of the food and the position in the oven at which the food is placed vary widely, and hence it is necessary to enhance the detection accuracy by increasing the number of infrared detection areas. FIG. 3 is an external view of a microwave oven of an embodiment of the present invention which is constructed to meet the above requirement. FIG. 4 is a perspective view of a heating cavity 4 and peripheral portions thereof, and FIGS. 5(*a*) and (*b*) show top plan views of choppers 17 and 18, respectively. In FIG. 3, numeral 8 designates a time setting dial, 9 a temperature setting dial, 10 a cook lamp, and 11 a cook switch. In FIG. 4, a magnetron 13 generates high frequency waves which are fed through a wave guide 14 to the heating cavity 4 from the top thereof. A chopper cavity 6 of the metal body is formed at the top of the heating cavity 4. An infrared detector 5 is mounted substantially at the center of the top plate of the heating cavity and choppers 17 and 18 are provided to chop the infrared ray directed to the infrared detector 5. The choppers 17 and 18 are made of stainless steel polished to form a mirror surface and rotated by a drive motor 19 through pinch rollers 20 and 21, respectively, having different diameters. Top plan views of the choppers 17 and 18 are shown in FIGS. 5(*a*) and (*b*), respectively. Since the choppers are rotated at different speeds from each other either in the same direction or in the opposite directions, the slots 23 in the chopper 17 and the holes 24 in the chopper 18 coincide sequentially to allow the passage of the infrared ray therethrough so that the infrared detection points on the bottom plate of the heating cavity can be increased to a great number. However, since the choppers 17 and 18 are flat, and since the distances from the infrared detector 5 to the holes 24 in the chopper 18 are not fixed, the solid angle varies from hole to hole. In order to compensate for the errors due to such variation, diameters of the holes may be changed in proportion to the distance from the infrared detector 5 to the holes 24 in the chopper 18 or the choppers 17 and 18 may be formed in semi-spherical structure and the infrared detector 5 is positioned at the center of the sphere so that the distance from the infrared detector 5 to the holes in the chopper 18 is always maintained at a fixed value.

Figure 6:
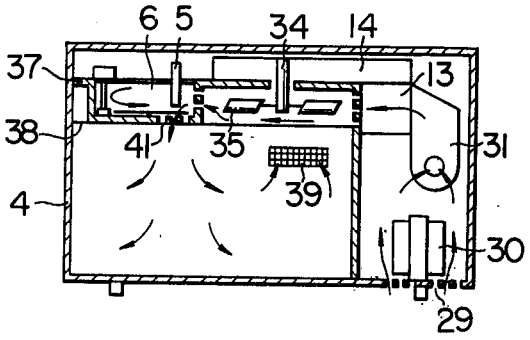
FIG. 6 is a sectional view illustrating a path of air flow in the microwave oven shown in FIG. 3.

In FIG. 6, air flow in the microwave oven shown in FIG. 3 is shown by the arrows. Air sucked through air intake apertures 29 formed at the bottom of the microwave oven cools electrical parts such as a transformer 30 and then it is circulated by a fan motor 31 to cool a magnetron 13 and rotates a stirrer 35, thence it enters a chopper cavity 6 formed between a top plate 37 and a partition 38, through a metal screen 41 mounted in front of a radiation detector 5 into the heating cavity 4, whereby water vapor from the food is exhausted from an exhaust port 39, high frequency waves generated by the magnetron 13 are fed to the heating cavity 4 through the wave guide 14 and an antenna 34 and are stirred and distributed by the stirrer 35. Since it is necessary for the radiation detector 36 to be able to view the entire area of the bottom of the heating cavity 4, the aperture at the bottom of the chopper cavity 6 in front of the radiation detector 5 should be fairely large. Therefore, a metal screen 41 is provided to prevent the entrance of the high frequency waves therefrom. The metal screen 41 used should have a large aperture rate so as to minimize the attenuation of the radiation emitted from the article to be heated. The structure of introducing the air into the chopper cavity 6 and ejecting it through the metal screen 41 into the heating chamber 4 serves to not only prevent the deposition of water vapor on the radiation detector 5 but also to keep the chopper at a constant temperature.

Figure 7:
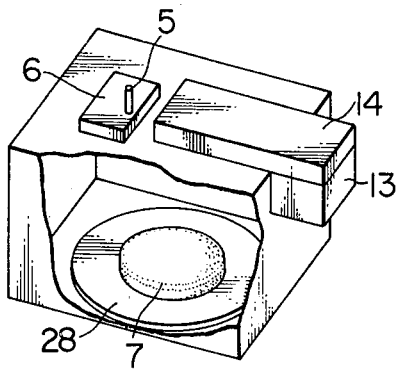
FIG. 7 is a perspective view, partly broken away, showing an embodiment having means for moving an article to be heated.
Figure 8:
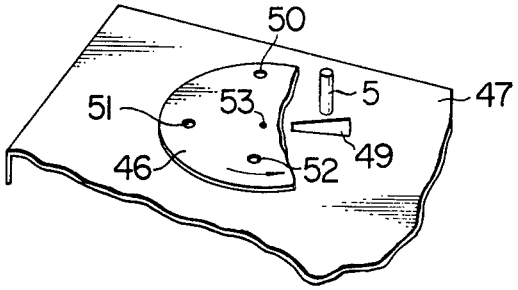
FIG. 8 is a perspective view showing a internal structure of a chopper cavity in FIG. 7.
Figure 9:
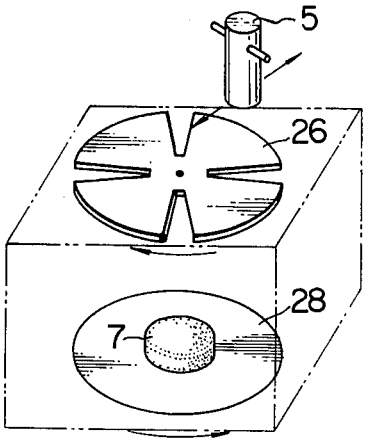
FIG. 9 is a perspective view showing another embodiment of the chopper.

FIGS. 7, 8 and 9 relate to a microwave oven in which a food 7 is carried on and rotated by a turn table 28. They show an example in which the structure of the chopper can be greatly simplified. Referring to FIG. 7, numeral 6 designate a chopper cavity, 5 a radiation detector, 13 a magnetron and 14 a wave guide. FIG. 8 shows an internal structure of the chopper cavity 6. Holes 50, 51 and 52 formed in the chopper 46 have different distances from the center of the chopper 46 so that when the chopper 46 rotates the holes 52, 51 and 50 sequentially coincide with a sector slot 49 formed in a top plate 47 of the heating cavity to chop the radiation directed toward a radiation detector 5 with the position of the passage of the radiation shifting radially of the chopper 46. The slot 49 in the top plate 47 of the heating cavity is aligned with a radial direction of the turn table 28 and the rotation speed of the turn table 28 is rendered independent of the rotation speed of the chopper 46. As a result, an infinite number of detection points occurs on the turn table 28. FIG. 9 shows a modification in which a radiation detector 5 is scanned in order to shift the detection point for the radiation radially of the turn table 28. In this method, since the detection points on the turn table 28 increase not only circumferentially of the turn table 28 but also radially thereof, the detection accuracy is further enhanced. The radiation detector 5 used in this embodiment is an infrared detector having a small incident angle because the sizes of the detection points on the turn table 28 should be sufficiently smaller than that of the food 7. The turn table 28 is made of a metal having a low emissivity, such as a stainless steel plate having a mirror polished surface.

Figure 10:
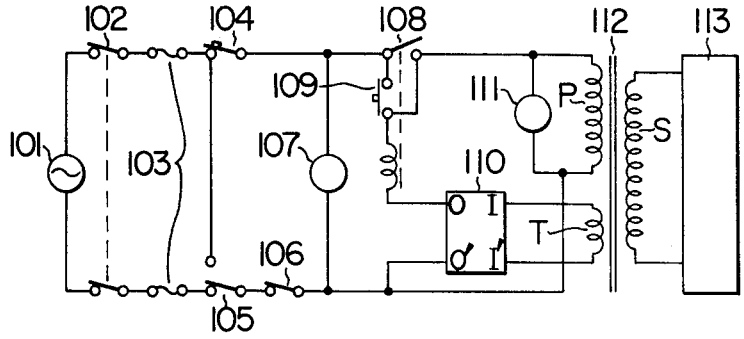
FIG. 10 shows an example of a power control circuit of a microwave oven with an infrared detection device.
Figure 11:
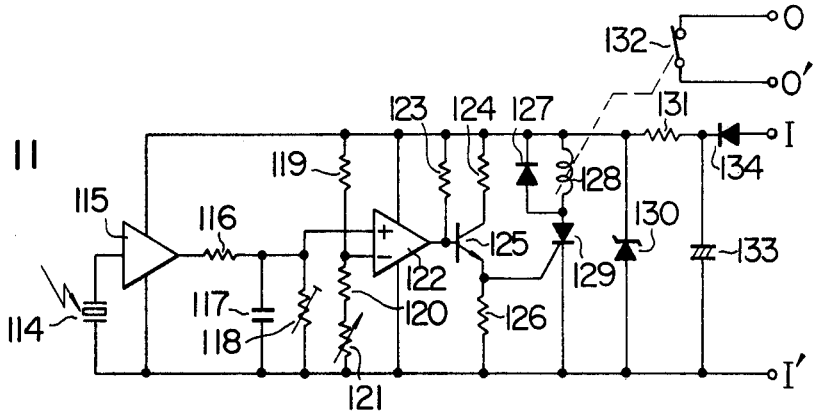
FIG. 11 shows a circuit diagram of the infrared detection device of FIG. 10.

One example of a power control circuit of the microwave oven using the infrared detector is shown in FIG. 10, in which 101 designates a power supply, 102 a safety switch, and 103 a fuse. By closing a door of the microwave oven, a door switch 105 and latch switch 106 are closed, and by closing a main switch 104 a fan motor 107 starts to be ready for cooking action. When a "cook" switch 109 is depressed, a contact of a main relay 108 is closed and a cooking lamp 111 is turned on and a primary winding P of a high voltage transformer 112 is supplied with a voltage so that a high frequency wave generator 113 connected to a secondary winding S starts to oscillate and a voltage is supplied via tertiary winding T to an infrared detector 110. When the temperature of an article to be heated reaches a predetermined temperature, terminals O–O′ of the infrared detector 110 are opened to stop the cooking. FIG. 11 shows a circuit of the infrared detector. A small voltage generated from an infrared sensing element 114 is amplified by a preamplifier 115 having a high input impedance and the output therefrom is integrated by a resistor 116 and a capacitor 117. The integrated signal voltage is compared by means of a comparator 122 with a voltage divided by a resistors 119, 120 and a temperature setting resistor 121, and when the signal voltage is larger, a transistor 125 triggers an SCR 129 to energize a relay 128 to open its normally closed contact 132. A diode 134, a capacitor 133, a resistor 131 and a Zener diode 130 constitutes a D.C. constant voltage source and a resistor 118 serves as a discharge resistor.

Figure 12:
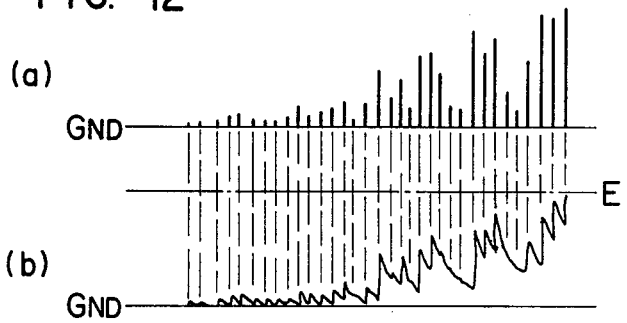
FIG. 12 shows waveforms in the infrared detection device in which (*a*) shows an output waveform of a preamplifier and (*b*) shows a plus (+) input waveform of a comparator.

FIG. 12 shows an output signal (*a*) of the preamplifier 115 and a plus (+) input signal (*b*) of the comparator 122. Letter E designates a preset cooking finished signal which is applied to a minus (−) input of the comparator 122.

What is claimed is:

1. A microwave oven comprising a heating cavity in an oven body, a high frequency wave generator for feeding high frequency waves into said heating cavity, radiation detecting means for sequentially detecting radiations from at least two points within said heating cavity, and control means for controlling said high frequency wave generator by signal from said radiation detecting means, said control means controlling said high frequency wave generator by a signal from that one of said two points which is at relatively higher temperature.

2. A microwave oven according to claim 1 wherein said radiation detecting means includes a radiation detector and chopper means such that a plurality of radiation detecting points can be defined by the combination of two choppers.

3. A microwave oven according to claim 2 wherein said plurality of choppers have different rotation speeds.

4. A microwave oven according to claim 1 wherein said radiation detecting means is mounted at substantially the center of a top plate of said heating cavity.

5. A microwave oven according to claim 1 wherein said radiation detecting means includes a radiation detector, chopper means and a metallic chopper cavity for accomodating the chopper means, said chopper cavity being arranged at the top of the heating cavity.

6. A microwave oven according to claim 5 wherein cooling air is fed into said chopper cavity to cool the radiation detector.

7. A microwave oven according to claim 5 wherein a metal screen is arranged to oppose to said radiation detector.

8. A microwave oven according to claim 1 wherein said radiation detecting means includes a radiation detector and chopper means, the chopper being formed with holes the diameters of which change in proportion to the distance from said radiation detector to the respective holes.

9. A microwave oven according to claim 1 wherein said radiation detecting means includes a radiation detector and chopper means, the chopper means including a chopper having a plurality of slots formed therein and a chopper having a plurality of holes formed therein.

10. A microwave oven according to claim 1 wherein said radiation detecting means covers respectively said at least two points with equal solid angles.

11. A microwave oven comprising a heating oven in an oven body, a high frequency generator for feeding a high frequency wave into said heating cavity, radiation detecting means for detecting radiations from at least two points within said heating cavity, control means for controlling said high frequency generator by a signal from said radiation detecting means, and a turn table for rotating an article to be heated placed in said heating cavity, said radiation detecting means detecting the temperature while it is scanned radially of the turn table.

* * * * *